US005531665A

United States Patent [19]

Chen

[11] Patent Number: 5,531,665

[45] Date of Patent: Jul. 2, 1996

[54] ROLLING MASSAGING DEVICE

[76] Inventor: Ping Chen, No. 20, Nan-Mei St., Taichung City, Taiwan

[21] Appl. No.: 368,147

[22] Filed: Dec. 29, 1994

[51] Int. Cl.[6] ..... A61H 1/00

[52] U.S. Cl. ..... 601/118; 601/132; 24/116 A

[58] Field of Search ..... 24/115 G, 136 B, 24/135 R, 616, 116 A; 63/2; 601/118, 124, 132

[56] References Cited

U.S. PATENT DOCUMENTS 1,177,505 3/1916 Fleming ..... 24/116 A
1,245,965 11/1917 Pratt ..... 63/2
1,702,991 2/1929 Bechmann ..... 601/132
3,957,039 5/1976 Ehren ..... 601/132

FOREIGN PATENT DOCUMENTS 814881 7/1937 France ..... 601/132

*Primary Examiner*—Robert A. Hafer
*Assistant Examiner*—David J. Kenealy
*Attorney, Agent, or Firm*—Ladas & Parry

[57] ABSTRACT

A massaging device includes a cord, a plurality of massaging balls and a plurality of biasing units strung alternately on the cord, and a connecting unit for joining two ends of the cord together. The biasing units ensure that the massaging balls remain evenly distributed on the cord.

4 Claims, 4 Drawing Sheets

ROLLING MASSAGING DEVICE

BACKGROUND OF THE INVENTION

1. Field of the Invention

The invention relates to a massaging device, more particularly to a massaging device which can provide a more effective massaging action than the prior art.

2. Description of the Related Art

Referring to FIG. 1, a conventional massaging device 3 is shown to comprise a cord 2 and a plurality of massaging balls 1 strung tightly on the cord 2. The massaging balls 1 are formed respectively with a diametrically extending through-hole la so as to permit stringing of the massaging balls 1 on the cord 2. The two ends of the cord 2 are tied together to form the massaging device 3 into a hoop. In use, the massaging device 3 is placed around the waist of the user. The user then twists his body so that the massaging device 3 twirls about his waist. The massaging balls 1 rub against the user to provide a massaging effect.

The main drawbacks of the conventional massaging device 3 are as follows: When the massaging device 3 is in use, the massaging balls 1 are subjected to centrifugal forces, thereby applying tension to the cord 2. After a period of use, the cord 2 stretches to result in gaps between adjacent ones of the massaging balls 1. The centrifugal forces that are present when the massaging device 3 is in use cause uneven distribution of the massaging balls 1 on the cord 2. That is, the massaging balls 1 that are in contact with the user's body are spaced farther apart than the remaining massaging balls 1 on the cord 2. This results in a relatively poor massaging action. In addition, since the two ends of the cord 2 are not concealed, the aesthetic appeal of the massaging device 3 is diminished.

SUMMARY OF THE INVENTION

The main object of the present invention is to provide a massaging device Which has massaging balls that can be kept evenly distributed on a cord when the massaging device is in use, thus resulting in an effective massaging action.

Another object of the present invention is to provide a massaging device with, a connecting unit which can join effectively the two ends of the cord without affecting adversely the appearance of the massaging device.

Accordingly, the massaging device of the present invention comprises a cord, a plurality of massaging balls and a plurality of biasing units strung on the cord, each of the biasing units being disposed respectively between adjacent two of the massaging balls, and a connecting unit for joining two ends of the cord together.

Each biasing unit includes a hollow round bead which consists of left and right bead halves that are formed as complementary hemispherical shells. The bead halves confine a respective receiving space and are formed with aligned cord holes to permit extension of the cord therethrough. Each biasing unit further includes a coiled compression spring sleeved on the cord and extending into the receiving spaces of the bead halves. The spring biases the bead halves away from each other.

The connecting unit includes left and right connectors formed as complementary hemispherical members which engage respectively the two ends of the cord. The left connector has an annular abutting end and a connecting portion which is surrounded by the abutting end and which includes a tubular shank that is formed with an external screw thread. The right connector has an annular abutting end and a connecting portion which is surrounded by the abutting end and which includes an annular recess that is confined by a surrounding wall formed with an internal screw thread for engaging the external screw thread.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
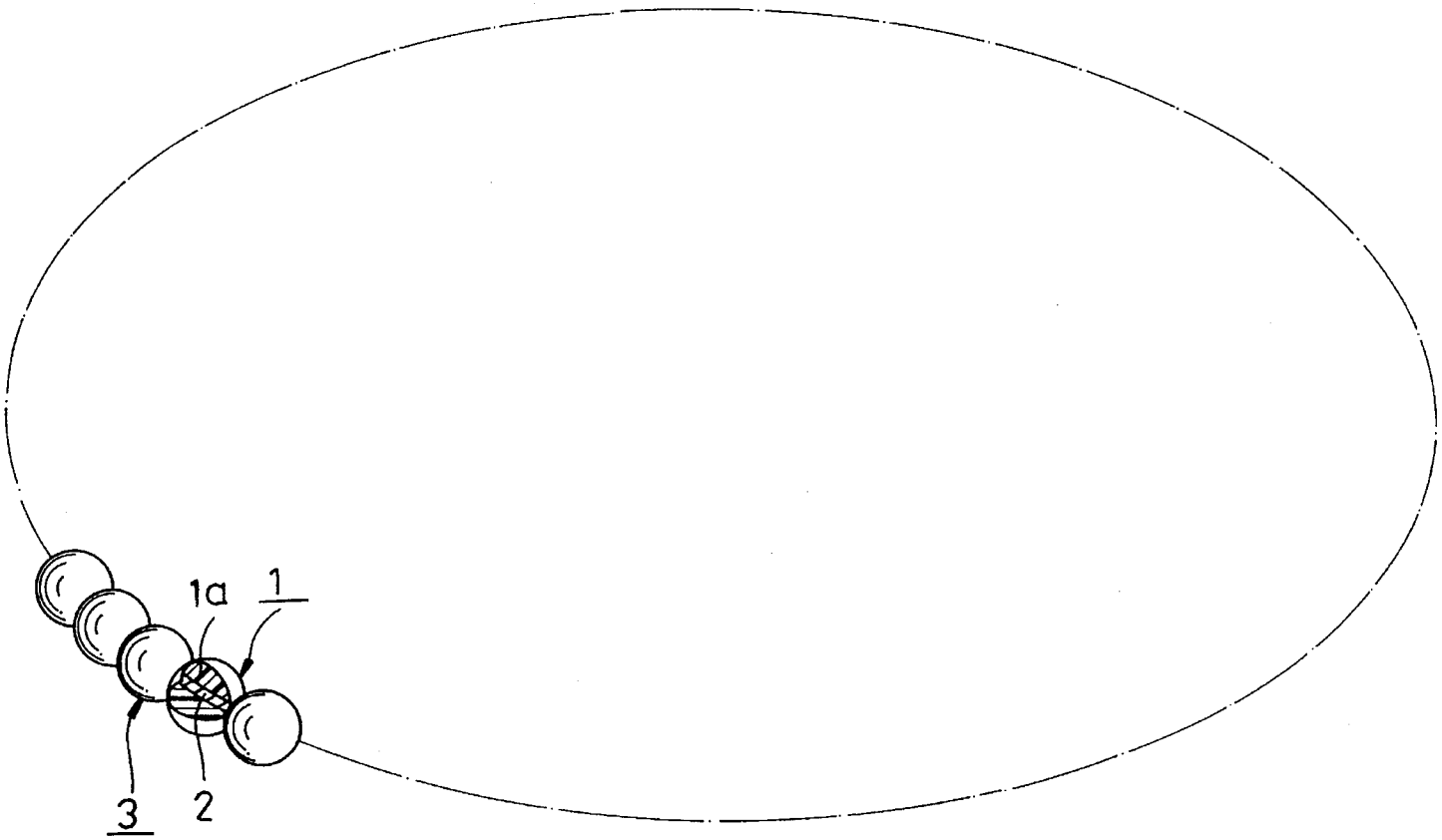
FIG.1 PRIOR ART
FIG. 1 is a perspective, partly sectional view of a conventional massaging device.
Figure 2:
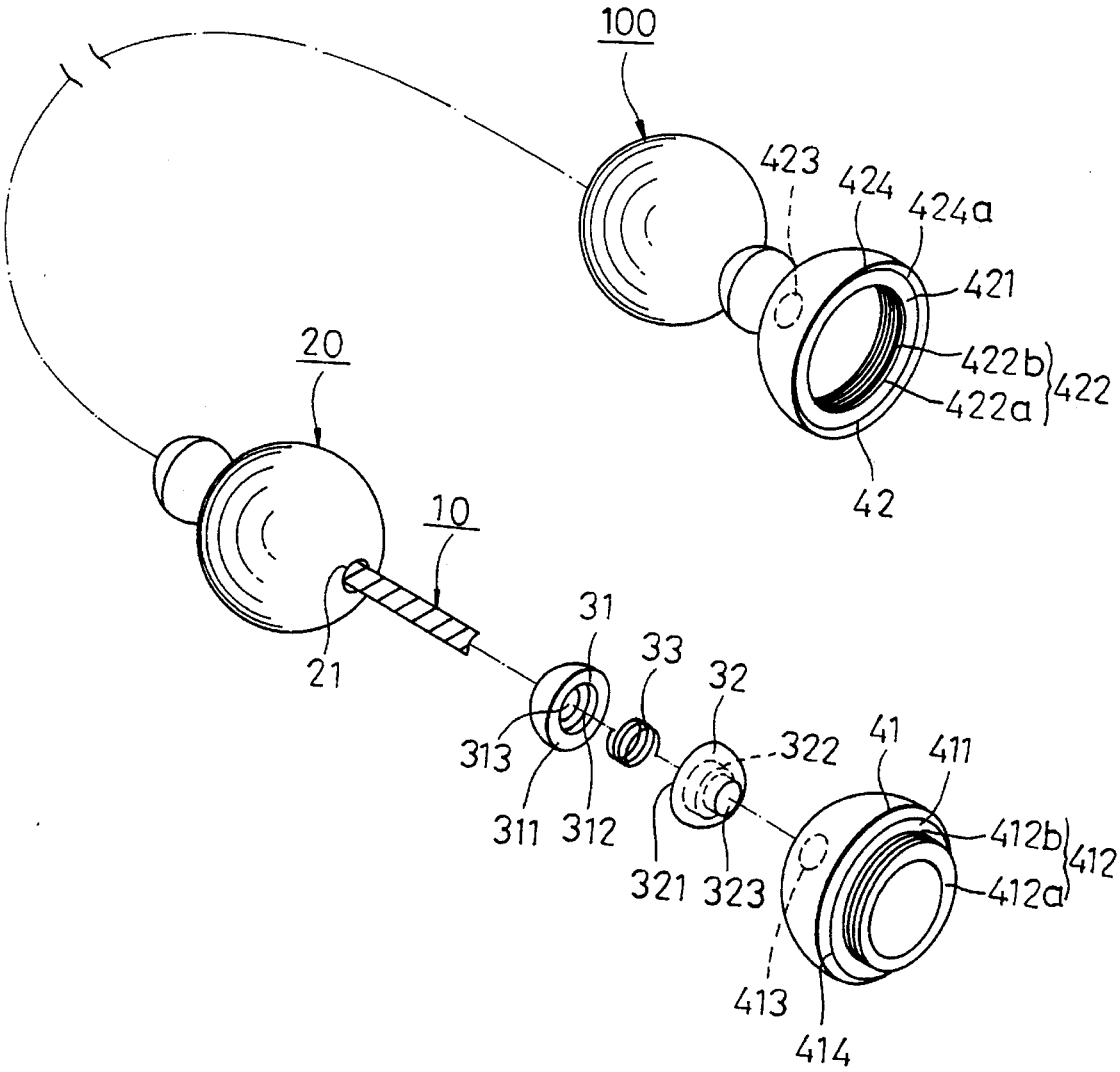
FIG. 2 is an exploded view of the preferred embodiment of a massaging device according to the present invention.
Figure 3:
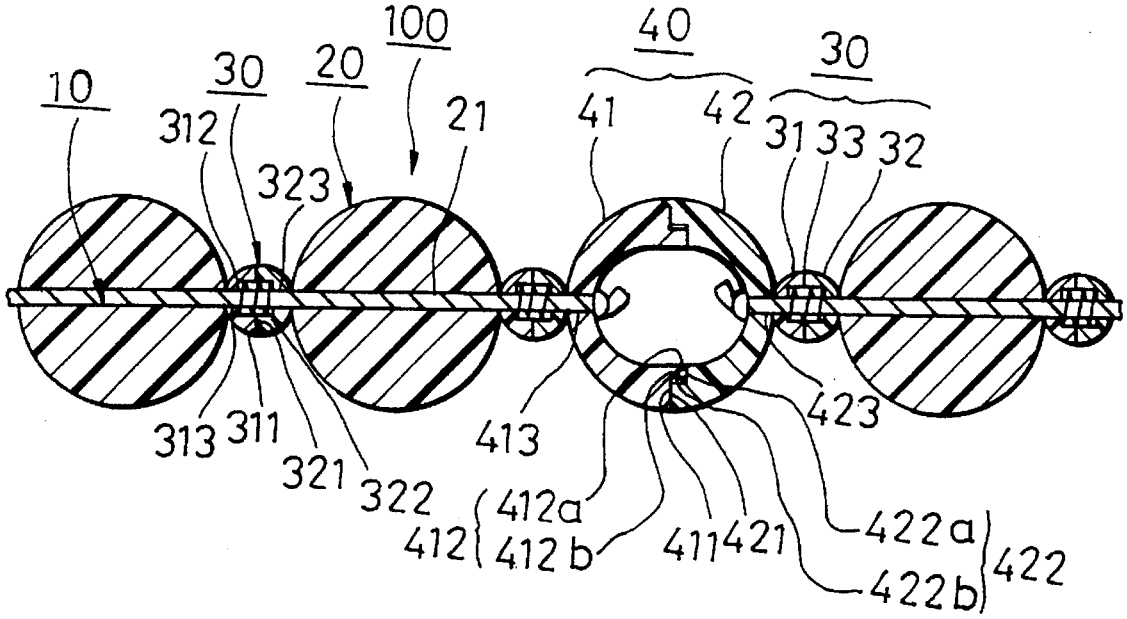
FIG. 3 is a sectional view of the preferred embodiment to illustrate its assembly.

Referring to FIGS. 2 and 3, the preferred embodiment of a massaging device 100 according to the present invention is shown to comprise a cord 10, a plurality of massaging balls 20, a plurality of biasing units 30 and a connecting unit 40.

The massaging balls 20 may be made of plastic and are formed respectively with a diametrically extending through-hole 21 so as to permit stringing of the massaging balls 20 on the cord 10. The biasing units 30 are similarly strung on the cord 10 and are disposed respectively between adjacent two of the massaging balls 10. Each biasing unit 30 includes a hollow round bead and spring 33. The hollow bead includes left and right bead halves 31, 32 that are formed as complementary hemispherical shells. The bead halves 31, 32 have annular abutting ends 311, 321 and confine a respective receiving space 312, 322. The bead halves 31, 32 are further formed with aligned cord holes 313, 323 to permit extension of the cord 10 therethrough. In this embodiment, the spring 33 is a coiled compression spring which is sleeved on the cord 10 and which extends into the receiving spaces 312, 322 of the bead halves 31, 32. The spring 33 biases the bead halves 31, 32 away from each other.

The connecting unit 40 includes left and right connectors 41, 42 formed as complementary hemispherical members. The connectors 41, 42 have annular abutting ends 411, 421. The left connector 41 further has a connecting portion 412 surrounded by the abutting end 411. The connecting portion 412 includes a tubular shank **412*a* that is formed with an external screw thread 412*b*. The right connector 42 further has a connecting portion 422 which is surrounded by the abutting end 421 and which includes an annular recess 422*a* that is confined by a surrounding wall formed with an internal screw thread 422*b*. The connectors 41, 42 are further formed with aligned cord holes 413, 423 to permit extension of a respective end of the cord 10 therethrough. A knot is tied at each of the two ends of the cord 10 to prevent removal of the connectors 41, 42 from the cord 10**.

The left connector 41 further has an annular inclined shoulder 414 around the abutting end 411. The right connector 42 further has an annular flange 424 around the abutting end 421. The annular flange 424 has a tip with an inclined face **424*a* that complements the inclined shoulder 414**.

Figure 4:
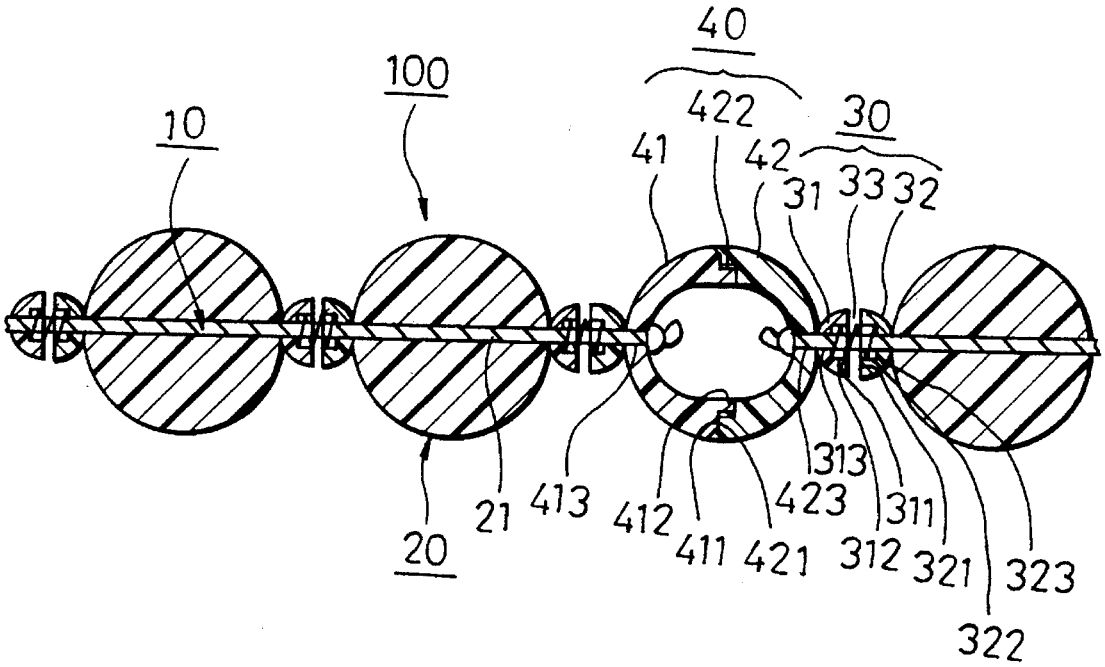
FIG. 4 is a sectional view which illustrates the preferred embodiment after a period of use.

The preferred embodiment is assembled in the following manner: Referring to FIGS. 2 and 3, a knot is initially tied at one end of the cord 10. The left connector 41 (or right connector 42) is strung on the cord 10 such that the former conceals the knot of the latter. The biasing units 30 and the massaging balls 20 are then strung alternately and tightly on the cord 10. After the last biasing unit 30 has been strung on the cord 10, the right connector 42 (or left connector 41) is then strung on the cord 10, and a knot is tied at the other end of the cord 10. The connecting portions 412, 422 of the connectors 42 are threaded together until the inclined face 424*a* of the annular flange 424 of the right connector 42 abuts firmly the inclined shoulder 414 of the left connector 41, thereby joining the two ends of the cord 100 together to form the massaging device 100 into a hoop. When assembled, the distance between adjacent massaging balls 20 is at a minimum, and the abutting ends 311, 321 of the bead halves 31, 32 abut firmly against each other to compress the springs 33 of the biasing units 30. Referring to FIG. 4, after the massaging device 100 has been in use for a period of time, tension to the cord 10 due to the centrifugal forces experienced by the massaging balls 20 causes the cord 10 to stretch. At this time, the springs 33 of the biasing units 30 expand and push the corresponding bead halves 31, 32 away from each other, thereby forming a gap between the bead halves 31, 32. The gaps between the bead halves 31, 32 of the biasing units 30 are equal in length, and the total length of the gaps between the bead halves 31, 32 of the biasing units 30 is equal to the increase in the length of the cord 10. Thus, even distribution of the massaging balls 20 on the cord 10 can be maintained to result in an effective massaging action. In addition, since the knots at the two ends of the cord 10 are concealed by the connecting unit 40, and since the connecting unit 40 has an appearance similar to that of the massaging balls 20, the aesthetic appeal of the massaging device 100 is not diminished.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A massaging device, comprising:

a cord;

a plurality of massaging balls strung on said cord;

a plurality of biasing units strung on said cord, each of said biasing units being disposed respectively between adjacent two of said massaging balls, each of said biasing units including a hollow round bead having left and right bead halves that are formed as complementary hemispherical shells, said bead halves confining a respective receiving space and being formed with aligned cord holes to permit extension of said cord therethrough, and a coiled compression spring sleeved on said cord and extending into said receiving spaces of said bead halves, said spring biasing said bead halves away from each other; and a connecting unit for joining two ends of said cord together.

2. The massaging device as claimed in claim 1, wherein said connecting unit comprises left and right connectors formed as complementary hemispherical members which engage respectively said two ends of said cord, said left connector having an annular abutting end and a connecting portion which is surrounded by said abutting end and which includes a tubular shank that is formed with an external screw thread, said right connector having an annular abutting end and a connecting portion which is surrounded by said abutting end and which includes an annular recess that is confined by a surrounding wall formed with an internal screw thread for engaging said external screw thread.

3. The massaging device as claimed in claim 2, wherein said connectors are formed with aligned cord holes to permit extension of the respective one of said ends of said cord therethrough, each of said two ends of said cord having a knot tied thereat to prevent removal of said connectors from said cord.

4. The massaging device as claimed in claim 2, wherein said left connector further has an annular inclined shoulder around said abutting end thereof, said right connector further having an annular flange around said abutting end thereof, said annular flange having a tip with an inclined face that complements and that abuts firmly said inclined shoulder when said left connector engages threadedly said right connector.

* * * * *